US005561891A

United States Patent [19]

Hsieh

[11] Patent Number: 5,561,891

[45] Date of Patent: Oct. 8, 1996

[54] FASTENER STRUCTURE BETWEEN A DIVING FLIPPER AND A TIGHTENING STRAP THEREOF

[76] Inventor: Hsing-Chi Hsieh, 1Fl., No. 22, Lane 125, Jen Ai Street, Sanchung City Taipei Hsien, Taiwan

[21] Appl. No.: 493,201

[22] Filed: Jun. 20, 1995

[51] Int. Cl.[6] ..... A44B 19/02

[52] U.S. Cl. ..... 24/573.1; 24/616; 24/615; 24/634; 24/639; 24/170; 24/171; 24/173; 24/191; 24/194; 24/633; 24/640

[58] Field of Search ..... 24/616, 615, 634, 24/639, 573.1, 163 K, 170, 171, 173, 191, 194, 633, 640

[56] References Cited

U.S. PATENT DOCUMENTS

| | | | |
|---|---|---|---|
| 3,201,840 | 8/1965 | Jantzen | 24/639 X |
| 3,656,211 | 4/1972 | Turner et al. | 24/194 X |
| 4,150,464 | 4/1979 | Tracy | 24/615 X |
| 4,688,337 | 8/1987 | Dillner et al. | 24/615 X |
| 4,692,970 | 9/1987 | Anthony et al. | 24/639 X |
| 4,831,694 | 5/1989 | Kong | 24/615 X |
| 4,945,614 | 8/1990 | Kasai | 24/615 X |
| 5,027,481 | 7/1991 | Frano | 24/616 X |
| 5,170,539 | 12/1992 | Lundstedt et al. | 24/194 X |
| 5,355,562 | 10/1994 | Matoba et al. | 24/615 X |
| 5,383,257 | 1/1995 | Krauss | 24/616 X |
| 5,465,472 | 11/1995 | Matoba | 24/616 X |

*Primary Examiner*—Peter M. Cuomo
*Assistant Examiner*—Stephen Vu
*Attorney, Agent, or Firm*—Pro-Techtor International

[57] ABSTRACT

The present invention offers a fastener structure between a diving flipper and a tightening strap thereof which is characterized in the following design the fastener comprises a male fastener and a female fastener; the male fastener is-provided at one end of the tightening strap, a tenon extending forward is formed at the front end of the male fastener, a recess is provided in a suitable position on each of two sides of the tenon, a holding down plate at the top of male fastener can adjust the tightness of tightening strap and brake the tightening strap from time to time; the female fastener is combined on one side of the diving filpper, a fastening plate pivotally provided on each of two sides of the female fastener extends inward from outside, the inner end of fastening plate has a catch, another end (outer end) thereof has a pressing portion, a bevel arm on one side of the fastening plate contacts against the inner walls on two sides of the housing so as to keep the catch at inner end of fastening plate tending to catch inward from time to time; and a covering plate on the top of the female fastener is designed to pivotally fix the fastening plate, an elastic retaining plate on each of two sides of the covering plate is aimed at retaining the male fastener and when to release fastening, pushing aside the male fastener; when the tenon of male fastener is inserted in the female fastener in place, the catch at inner end on each of two sides of the female fastener is caught in a recess on each of two sides of the tenon of the male fastener; and when the pressing portion at the outer end of each fastening plate is pressed inward, the catch at inner end thereof moves outward relatively so as to release the catch from catching in the recess on each of two sides of the tenon of the male fastener.

5 Claims, 2 Drawing Sheets

FASTENER STRUCTURE BETWEEN A DIVING FLIPPER AND A TIGHTENING STRAP THEREOF

BACKGROUND OF THE INVENTION

1. Field of the Invention

The present invention is related to a fastener structure and particularly to a fastener structure between a diving flipper and a tightening strap thereof which can be quickly fastened and released.

2. Description of the Prior Art

A diver wears a pair of diving flippers on his feet for activities in the water to help him quickly move his position therein. The tightness of a tightening strap provided at the rear end of diving flipper is adjustable in keeping with his wearing same with a suitable tightness. A fastener structure provided between a diving flipper and a tightening strap for combing both the diving flipper and the tightening strap is always required to be quickly fastened and released.

The fastener structure has a plurality of models with their own respective features. The present invention offers a novel fastener structure of which the operation of fastening and releasing is quite simple and convenient.

SUMMARY OF THE INVENTION

A fastener structure between a diving flipper and a tightening strap according to the present invention is characterized in the following design: the fastener comprises a :male fastener and a female fastener, wherein the male fastener is provided at one end of the tightening strap, a tenon at the front end of male fastener extends towards, a recess is provided in a suitable position on each of two sides of the tenon, and a holding down plate on the top of male fastener can adjust the tightness of tightening strap and brake the tightening strap from time to time; the female fastener is provided on one side of the diving flipper, a fastening plate pivotally provided on each of two sides of the female fastener extends inward from outside, a catch is formed at the inner end of the fastening plate, another end (outer end) thereof is a pressing portion, a bevel arm on one side of the fastening plate to contact against the inner walls on two sides thereof so as to keep the catch at the inner end of fastening plate tending to fasten inward, a covering plate on the top of female fastener is designed to pivotally fix the fastening plate, an elastic retaining plate on each of two sides of the covering plate is designed to retain the male fastener and upon releasing to push away the male fastener; and when the tenon of male fastener is inserted in the female fastener in place, the catches at the inner ends of fastening plates on two sides of female fastener catch the recesses on two sides of tenon of male fastener naturally; and when the pressing portion at the outer end of the fastening plate is pressed inward, the catch on the inner end thereof is relatively moved outward to release the catch from catching the recesses on the two sides of tenon of the male fastener.

DETAILED DESCRIPTION OF THE PREFERRED EMBODIMENTS

Figure 1:
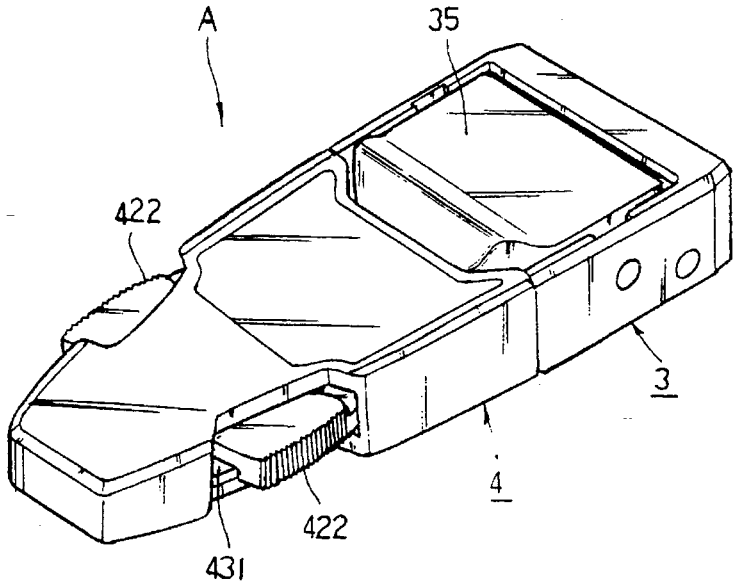
FIG. 1 is an elevational appearance view of fastener of the present invention.
Figure 2:
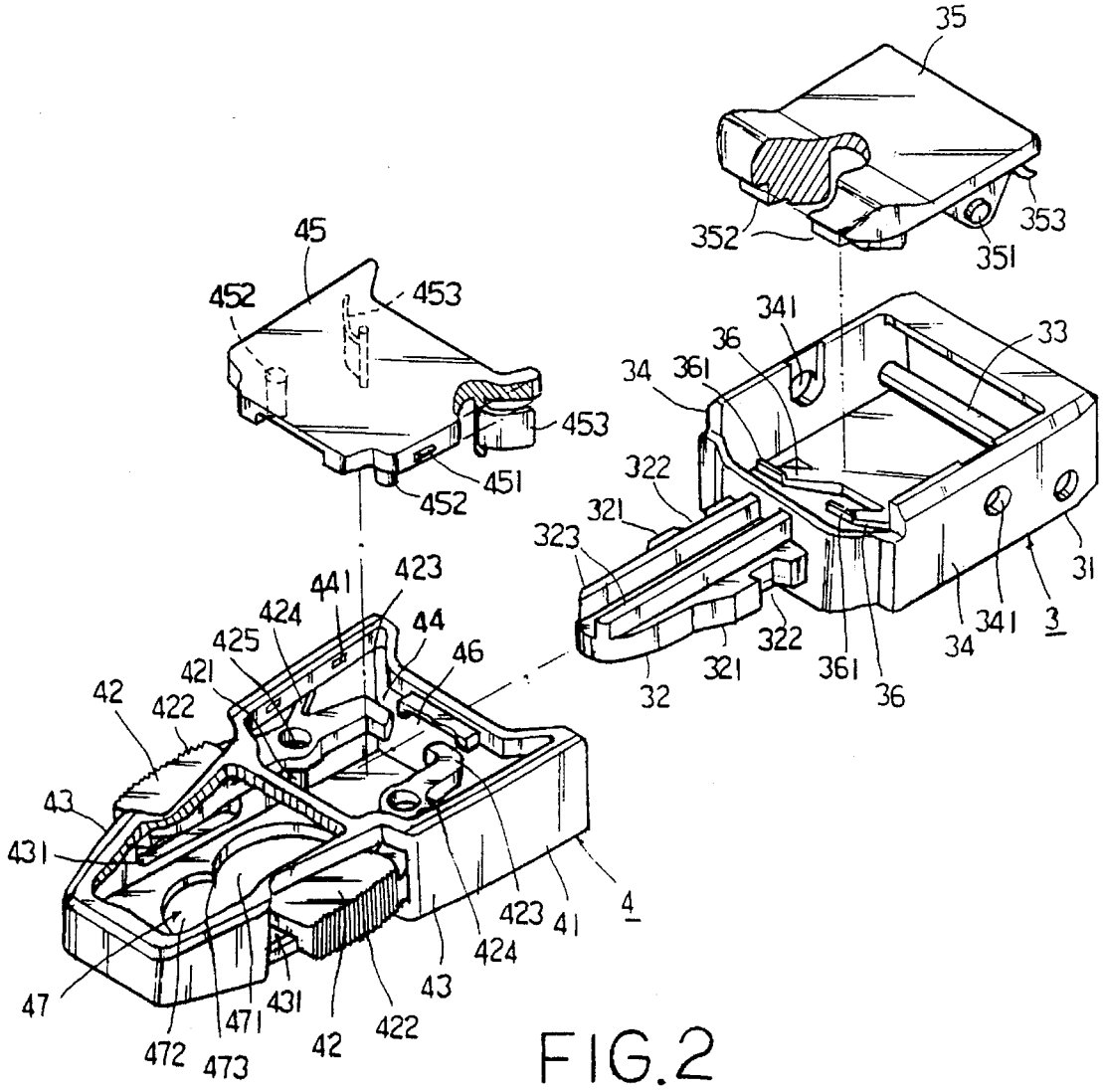
FIG. 2 is a breakdown view of fastener of the present invention.
Figure 3:
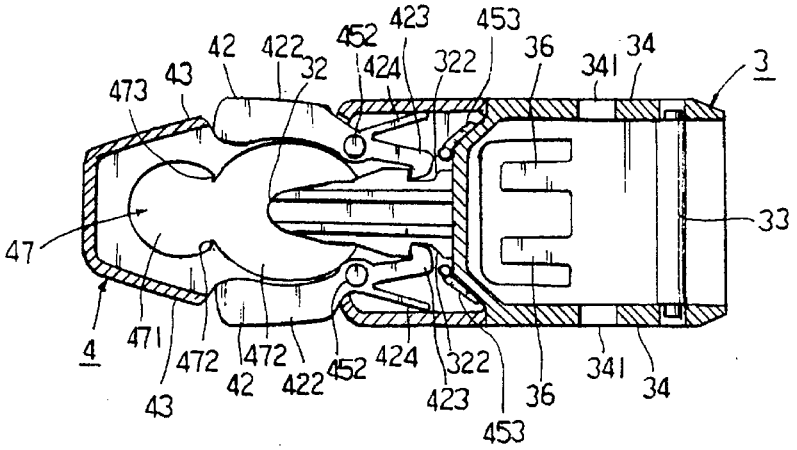
FIG. 3 is a lateral sectional view of fastener of the present invention.

A fastener(A) is essentially designed to combine a diving flipper(1) and a tightening strap(2). As shown in the drawings, the fastener(A) comprises a male fastener(3) and a female fastener(4). The male fastener(3) has a housing(31) of which the front end wall has a tenon(32) to extend forward, a wing(321) is on each of two sides of the tenon(32), a recess(322) in a suitable position on one side of the wing(321), and more than one convex track(323) provided on the top of tenon(32) (two convex tracks thereon in the drawings of one example) can decrease the friction resistance when inserting the tenon(32) in the female fastener(4). A lateral revolving shaft(33) in a position nearby the rear end inside the housing (31) is designed to wind the tightening strap(2).

Figure 4:
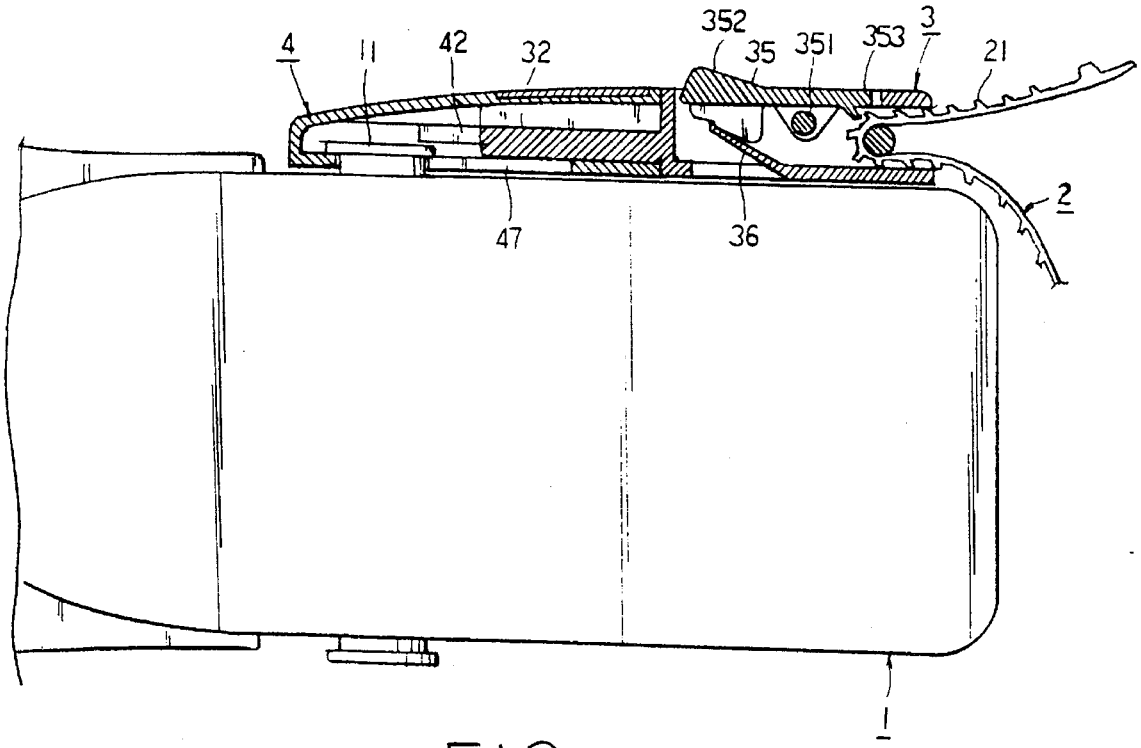
FIG. 4 is a longitudinal sectional view of fastener of the present invention and shows the fastener assembled with a diving flipper and tightening strap.

A pivot hole(341) on each of two side walls(34) of the housing(31) is designed to install a pivot(351)on each of two sides of a holding down plate(35) so that the front and rear ends of the holding down plate(35) can act reversely up and down in respect of the pivot(351) as a fulcrum. The holding down plate(35) with the foregoing pivot(351) is on the top of the housing(31), and at least more than one pressing block(352) (two pressing blocks in the drawings of one example) is inside the front end of the holding down plate(35), and a bevel convex tooth(353) toward lower rear is inside the rear end of the holding down plate(25). A bevel elastic piece(36) toward front is provided in each position corresponding to the pressing block(352) of holding down plate(35), an upward convex upright wall(361) is formed at the end of each elastic piece(36) to contact against the pressing block(35) of the holding down plate(35) so as to keep the front end of the holding down plate(35) tending to be upward from time to time and the rear end of the holding down plate dropping and to keep the bevel convex tooth(353) inside the rear end thereof tending to be dropping between the convex teeth(21) of the tightening strap(2) from time to time (as shown in FIG. 4) so as to prevent the tightening strap(2) from lossening inward reversely but can tighten the tightening strap(2) forward outward. However, to press down the front end of the holding down plate(35) can lift the rear end of the holding down plate(35) and release the bevel convex tooth(353) from binding the convex teeth(21) of the righting strap(2) so as to loosen the tightening strap(2).

The foregoing female fastener(4) also has a housing(41), a fastening plate(42) on each of two sides of the housing(41) extends inward from outside to be pivotally combined with the bottom of housing(1) through a shaft(421), a pressing portion(422) is formed at the outer end of each fastening plate(42) and extends out of an opening(431) on each housing wall(43) on two sides of the housing(41), a catch(423) is formed at the inner end of each fastening plate(42), and the catch(423) at the inner end and the pressing portion(422) at the outer end thereof can act reversely inward and outward in respect of the shaft as a fulcrum. A bevel arm(424) on the outer side nearby the inner end of each fastening plate(42) contacts against the inner wails on two sides of the housing wall(43) so as to keep the catch(423) at the inner end of the fastening plate(42) tending to catch inward from time to time.

A covering plate(45) covers an opening(44) on the top of the housing (41) of the female fastener(4) through a convex catch(451) on the two sides of covering plate(45) and a concave recess(441) on the side wall of the opening(44) to catch each other. A convex shaft(452) is provided in a position on each of two sides of the covering plate(45) corresponding to the shaft(421) of the fastening plate(42) to be mutually and pivotally combined with a concave hole(425) on the top of the fastening plate(42) so as to pivotally fix the fastening plate(42). An elastic retaining plate(453) on each of the two sides at the bottom at rear end of the covering plate(45) is in keeping with the shape on two sides on the front end wall of the housing(31) of the male fastener(3). When the male and female fasteners(3) and (4) catch each other in place, the elastic retaining plate(453) can prevent the male fastener(3) from moving forward continuously; and when the male and female fasteners(3) and (4) release from each other, the elastic retaining plate(453) can push the male fastener(3) outward.

In addition, a concave track(46) in a position inside the top of housing(41) of the female fastener(4) is corresponding to the convex track(323) on the top of tenon(32) of the male fastener(3) for mutual engagement and decreasing mutaul friction resistance. Furthermore, an assembling/disassembling hole(47) comprising a large hole(471) and a small hole(472) connected to each other at the bottom of housing(41) is designed to contain each convex button(11) on two sides at rear end of the diving flipper(1). Two convex check teeth (473), (473) to bevel and protrude toward the direction of the small hole(472) are formed on the hole wall on the two sides in a position where the large and small holes(471), (472) are connected to each other to let the convex button(11) of the flipper(1) be contained in the small hole(472) through the large hole(471). Once it is well contained, the convex check teeth (473) can prevent the convex button(11) from sliding out of the small hole(472), to wit, to prevent the fasteners(3), (4) from disengaging from each other.

When the tenon(32) of male fastener(3) is initially inserted in the female fastener(4), the front end of tenon(32) can push the catches(423) of fastening plates(42) of the female fastener(4) so as to let the tenon(32) pass smoothly until the recesses(322) on two sides of the tenon(32) align with the catches(423) of the fastening plates(42), the catches(423) are caught in the recesses(322) so that the male and female fasteners(3), (4) finish fastening each other, namely, the tightening strap(2) and the diving flipper(l) assemble each other quickly. Meantime, the elastic retaining plate(453) of covering plate(45) of the female fastener(4) blocks the front end wall of the male fastener(3) so as to prevent the male fastener(3) from going ahead. When the pressing portion(422) at the outer end of fastening plate(42) presses inward, the catch(423) at the inner end of the fastening plate(42) moves outward relatively so as to release the recess(322) on the tenon(32) of male fastener(3) from catching and to separate the male fastener(3) from the female fastener(4), and the elastic retaining plate(453) of covering plate(45) of female fastener(4) pushes the male fastener(3) outward, namely, to disengage the tightening strap(2) from the diving flipper(1) quickly.

In view of the above, the present invention offers a novel fastener structure between the diving flipper(1) and the tightening strap(2) of which the operation is rather simple and convenient and able to prevent the fastener from coming off the diving flipper.

I claim:

1. A fastener structure comprising:

a male fastener comprising a male housing including a front wall with a tenon extending in a forward direction, said tenon defining two side walls and two wings, wherein each of said wings includes a recess, said male fastener comprises a lateral revolving shaft near a rear end in an interior of said housing around which a strap is wound, each of said two side walls includes a pivot hole to receive a pivot of a holding down plate, said holding down plate includes more than one pressing block inside a front end thereof and a beveled convex tooth inside a rear end thereof, said male fastener further includes more than one beveled elastic piece each in a position corresponding to said pressing blocks so that said strap is releasably secured in position; and a female fastener comprising a female housing, defining two sides, with two fastening plates extending inward through openings in each of said two sides of said female housing, said fastening plates are pivotally attached to a bottom of said female housing, said fastening plates include a pressing portion on an outer surface thereof and a catch on an inner end, said fastening plates each include a flexible beveled arm at a point that is on a side of a pivot point of said fastening plate that includes said catch, said beveled arms contact inner walls of said female housing, thereby biasing said catches to improve their stability and to decrease a possibility of unintentional detachment of said catches when they are engaged with said recesses of said tenon of said male fastener, said female housing further includes a covering plate to cover an opening on a top side of said female housing, said covering plate including catches that are received in recesses in said inner walls of said female housing, a bottom surface of said female housing includes an assembling/disassembling hole comprising a large hole with a smaller hole connected thereto, said assembling/disassembling hole being adapted to receive a button of a diving flipper; wherein said fastener is secured by inserting said male fastener into said female fastener such that said catches of said female fastener are received in said recesses of said male fastener, said fastener being released by pressure applied to said pressing portions such that said biasing of said beveled arms is overcome and said fastening plates pivot to release said catches from said recesses.

2. The fastener of claim 1 wherein:

said beveled elastic pieces each include an upward angled wall at an end thereof.

3. The fastener of claim 1 wherein:

said tenon of said male fastener includes more than one convex track on a top side thereof, and said female fastener includes more than one corresponding concave tracks on an underside of said top side of said female housing.

4. The fastener of claim 1 wherein:

two elastic retaining plates conforming to the shape of a front end of said male housing are provided on a rear end of said covering plate of said female fastener.

5. The fastener of claim 1 wherein:

connection point of said large hole and said smaller hole of said assembling/disassembling hole, has two sides and includes a convex check tooth angled toward said smaller hole.

* * * * *